US007587839B1

(12) United States Patent
Winter

(10) Patent No.: US 7,587,839 B1
(45) Date of Patent: Sep. 15, 2009

(54) MILITARY RIBBON ALIGNMENT

(76) Inventor: Robert Winter, 5895 Janice Dr., Fairfield, OH (US) 45014

( * ) Notice: Subject to any disclaimer, the term of this patent is extended or adjusted under 35 U.S.C. 154(b) by 0 days.

(21) Appl. No.: 11/846,757

(22) Filed: Aug. 29, 2007

(51) Int. Cl.
*A41H 3/01* (2006.01)
*G01D 21/00* (2006.01)

(52) U.S. Cl. ..... 33/653

(58) Field of Classification Search ..... 33/653, 33/533, 613, 645, 562
See application file for complete search history.

(56) References Cited

U.S. PATENT DOCUMENTS 2,387,986 A 10/1945 Evans
2,821,787 A * 2/1958 Shepard ..... 33/653
3,092,915 A 6/1963 Bell
3,376,651 A 4/1968 Carey
3,690,013 A * 9/1972 Leptrone et al. ..... 33/613
4,302,884 A 12/1981 Pallone
4,638,569 A * 1/1987 Dove ..... 33/562
D291,287 S 8/1987 Eisenhauer
4,712,309 A * 12/1987 Kingston et al. ..... 33/562
4,770,216 A * 9/1988 Ruscak ..... 33/562
4,914,822 A * 4/1990 Wetherington ..... 33/562
5,107,600 A * 4/1992 Riesberg ..... 33/645
6,131,620 A 10/2000 Mette

* cited by examiner

*Primary Examiner*—Christopher W Fulton

(57) ABSTRACT

A military ribbon alignment assembly includes a first lateral member and a second lateral member that are spaced from each other. The first and second lateral members are aligned parallel with respect to each other. Each of the first and second lateral members has a first end, a second end, an upper edge and a lower edge. A plurality of horizontal members each has a top edge and a bottom edge. The bottom edges each have a plurality of bottom notches therein. The upper edges of the first and second later members are extended into one of the notches of each of the horizontal members. Military ribbons may be aligned vertically with the first and second lateral members and horizontally aligned with the horizontal members.

5 Claims, 5 Drawing Sheets

MILITARY RIBBON ALIGNMENT

BACKGROUND OF THE INVENTION

1. Field of the Invention

The present invention relates to alignment devices and more particularly pertains to a new alignment device for assisting a person in ensuring that their ribbons and medals are properly aligned and properly spaced from each other.

2. Description of the Prior Art

The use of alignment devices is known in the prior art. While these devices fulfill their respective, particular objectives and requirements, the need remains for a device that can be used to assist a person in aligning their military ribbons when placing such on a dress uniform. Further, the device should include means to allow the person to properly space medals from the ribbons.

SUMMARY OF THE INVENTION

The present invention meets the needs presented above by generally comprising a first lateral member and a second lateral member that are spaced from each other. The first and second lateral members are aligned parallel with respect to each other. Each of the first and second lateral members has a first end, a second end, an upper edge and a lower edge. The first and second ends of the first and second lateral members are aligned with each other. A plurality of horizontal members each has a pair of opposing ends. Each of the horizontal members has a top edge and a bottom edge. The bottom edges each have a plurality of bottom notches therein. Each of the bottom notches in one of the horizontal members is aligned with one of the bottom notches in each of the horizontal members when the opposing ends are aligned. The upper edges of the first and second later members are extended into one of the notches of each of the horizontal members. Military ribbons may be aligned vertically with the first and second lateral members and horizontally aligned with the horizontal members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
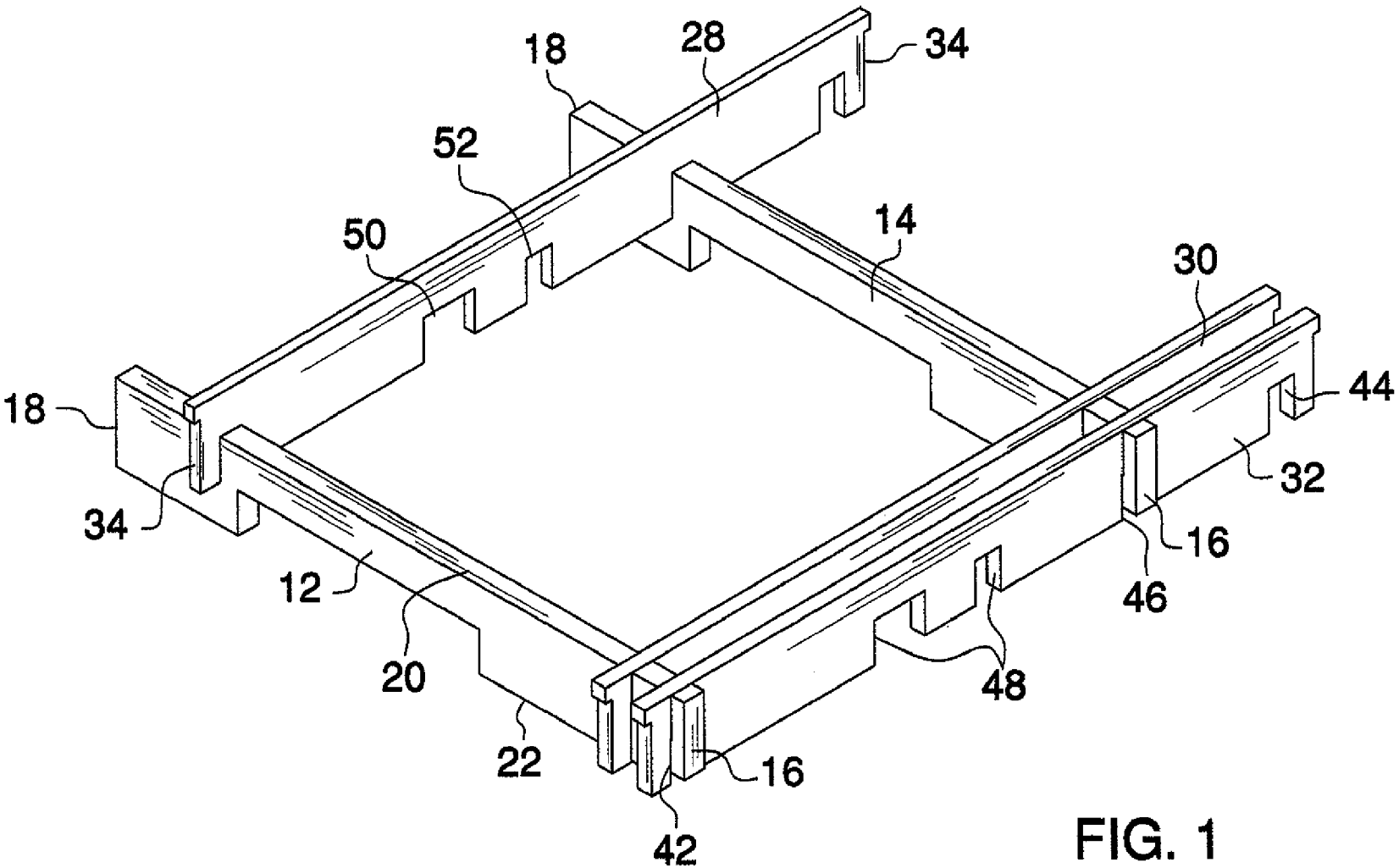
FIG. 1 is a perspective view of a military ribbon alignment assembly according to the present invention.
Figure 2:
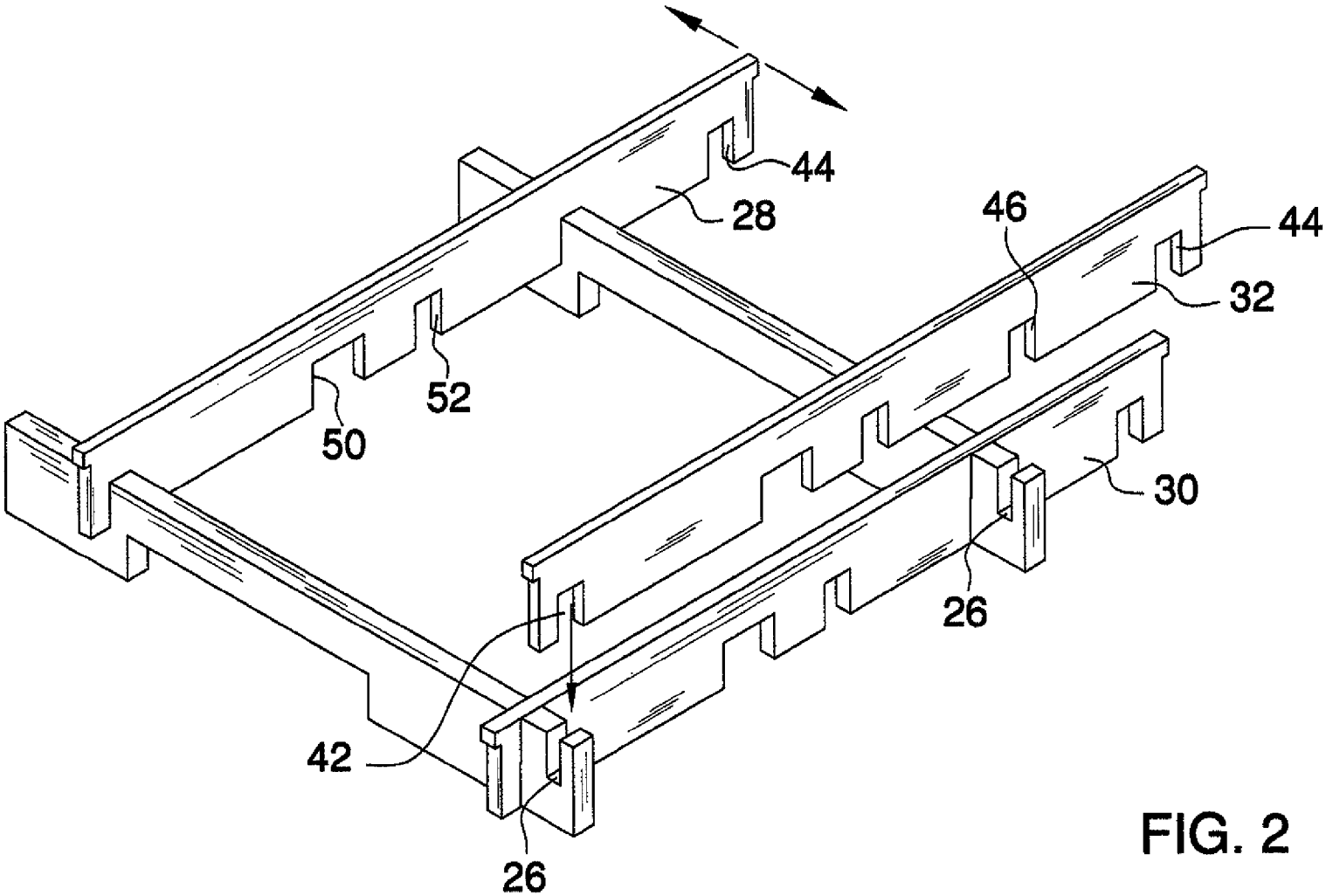
FIG. 2 is perspective view of the present invention.
Figure 3:
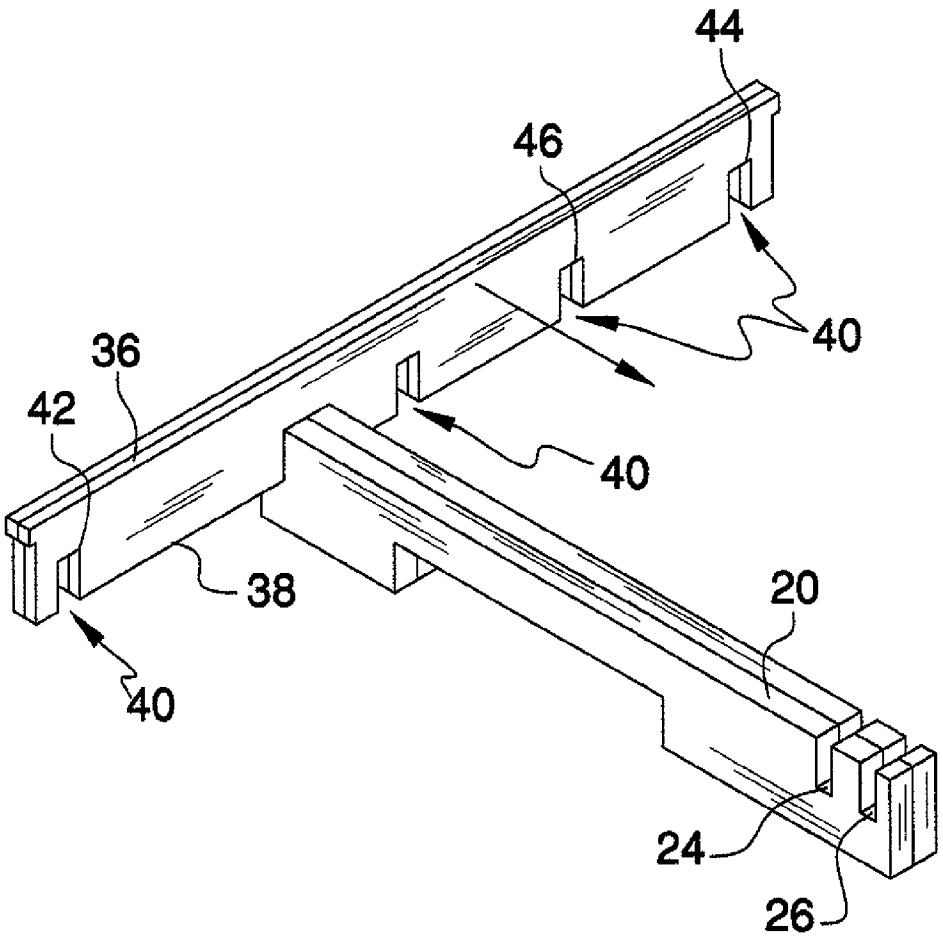
FIG. 3 is a perspective view of the present invention.
Figure 4:
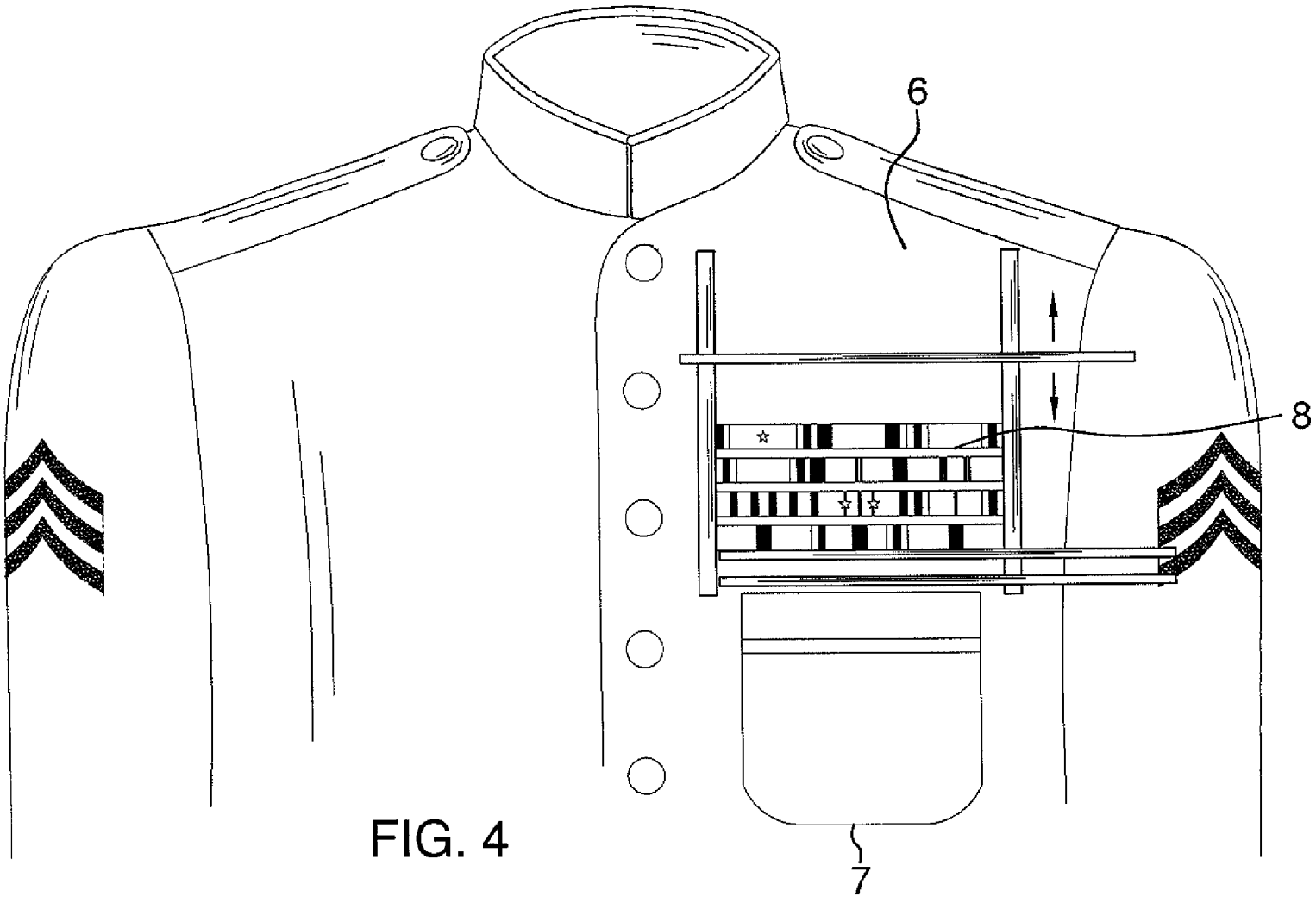
FIG. 4 is a top in-use view of the present invention.
Figure 5:
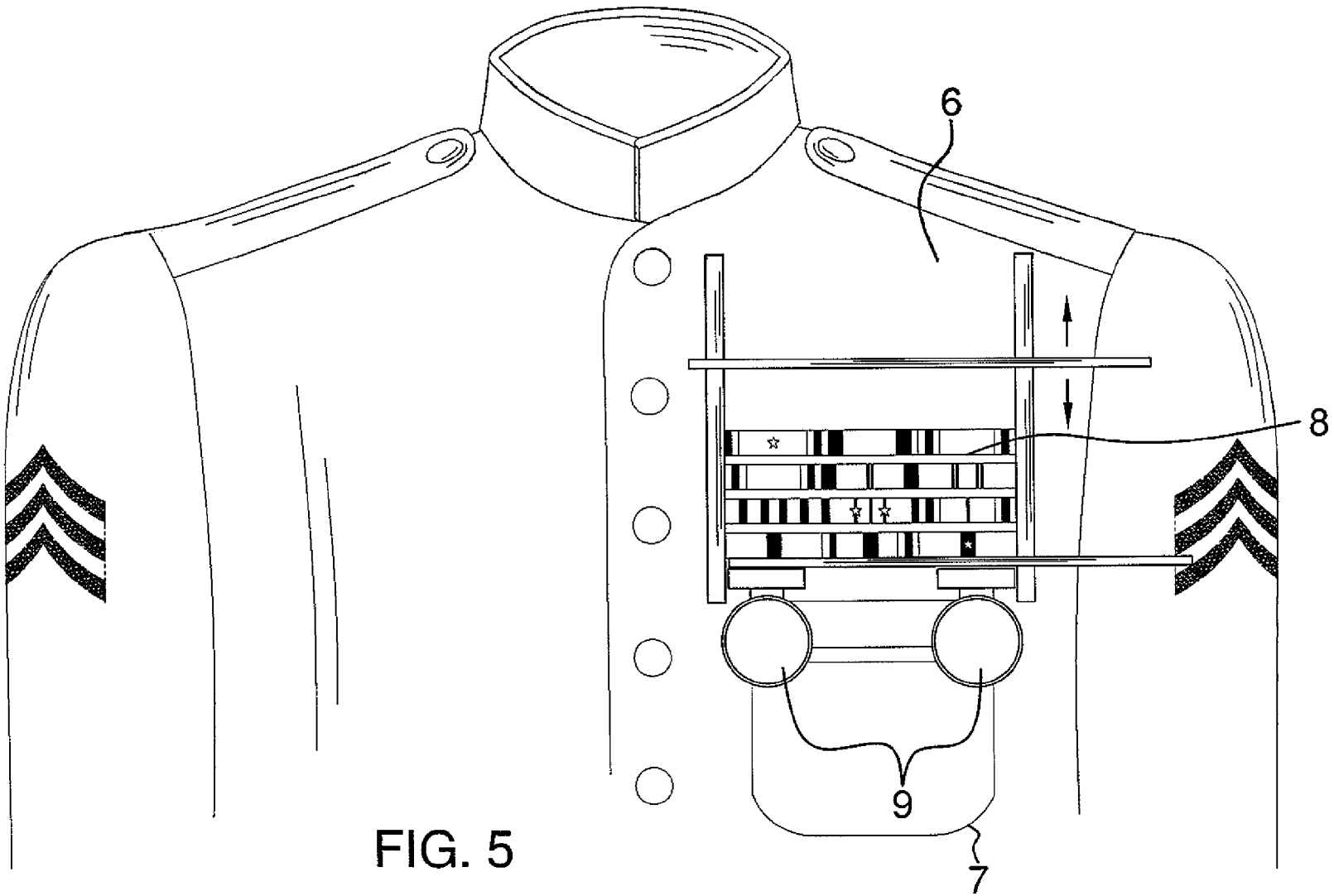
FIG. 5 is a top in-use view of the present invention.

With reference now to the drawings, and in particular to FIGS. 1 through 4 thereof, a new alignment device embodying the principles and concepts of the present invention and generally designated by the reference numeral 10 will be described.

As best illustrated in FIGS. 1 through 4, the military ribbon 8 alignment assembly 10 generally comprises a first lateral member 12 and a second lateral member 14 that are spaced from each other. The first 12 and second 14 lateral members are aligned parallel with respect to each other. Each of the first 12 and second 14 lateral members has a first end 16, a second end 18, an upper edge 20 and a lower edge 22. The first 16 and second ends 18 of the first 12 and second 14 lateral members are aligned with each other. Each of the upper edges 20 has a primary slot 24 therein positioned approximately ½ inch away from a respective one of the first ends 16. Each of the upper edges 20 has a secondary slot 26 therein positioned about ⅛ inch away from a respective one of the first ends 16. Each of the primary slots 24 is spaced ¼ inch from a corresponding one of the secondary slots 26. The primary 24 and secondary 26 slots each have a length equal to ⅛ inch measured along a line extending between the first 16 and second 18 ends. The first 12 and second 14 lateral members each have a length between corresponding ones of the first 16 and second 18 ends equal to approximately 5 inches and a width equal to approximately ¼ inch.

A plurality of horizontal members 28, 30, 32 is provided and each has a pair of opposing ends 34. A distance between the opposing ends 34 is greater than 6½ inches. Each of the horizontal members 28, 30, 32 has a top edge 36 and a bottom edge 38. The bottom edges each have a plurality of bottom notches 40 therein. Each of the bottom notches 40 in one of the horizontal members 28, 30, 32 is aligned with one of the bottom notches 40 in each of the other horizontal members 28, 30, 32 when the opposing ends 34 are aligned. The bottom notches 40 include a first outer notch 42, a second outer 44 and a prime notch 46 positioned between corresponding ones of the first 42 and second 44 outer notches. Each of the first outer notches 42 is spaced 4 3/16 inches from a corresponding one of the prime notches 46. Each of the first outer notches 42 is spaced 5⅝ inches away from a corresponding one of the second outer notches 44. These distances are common widths that will be used when aligning the military ribbons 8. The first outer notches 42 are each aligned with each other and receive the upper edge 20 of the first lateral member 12. The top edge 20 of the second lateral member 14 receives selected ones of the aligned ones of the bottom notches 40.

The plurality of horizontal members 28, 30, 32 includes a first horizontal member 28 and a second horizontal member 30. Each of the top edges 20 of the first 12 and second 14 lateral members is extended into one of the bottom notches 40 to form a rectangular frame. The first outer notch 42 of the second horizontal member 30 is engaged with the primary slot 24 of the first lateral member 12. The other bottom notch 40 of the second horizontal member 30 that receives the upper edge 20 of the second lateral member 14 is engaged with the primary slot 24 of the second lateral member. The first horizontal member 28 is positioned between the second horizontal member 30 and the second ends 18 of the first 12 and second 14 lateral members and the bottom notches 40 of the first horizontal member are engaged with the top edges 20 of the first 12 and second 14 lateral members. The plurality of horizontal members 28, 30, 32 includes a third horizontal member 32 that has a first outer notch 42 engaged with the secondary slot 26 of the first lateral member 12. The other bottom notch 40 of the third horizontal member 32 that receives the upper edge 20 of the second lateral member 14 is engaged with the secondary slot 26 of the second lateral member.

Tertiary bottom notches 48 may be added to vary the different widths required and to form T-shaped tools for alignment purposes. The first outer notches 42, second outer notches 44 and prime notches 46 each have a width equal to ¼ inch. The tertiary bottom notches 48 include at least a first tertiary notch 50 having a width equal to ½ inch and being spaced 1¾ inches from the first outer notch 42. At least one notch of the tertiary bottom notches 48 includes a second tertiary notch 52 having a width equal to ¼ inch and being spaced 1 3/16 inches from the prime notch 46.

In use, the military ribbons 8 may be aligned vertically with the first 12 and second 14 lateral members and horizontally aligned with the first 28 and second 30 horizontal members. The medals 9 are then abutted against the third horizontal member 32 to correctly space the medals 9 from the military ribbons 8. The third horizontal member 32 ensures that a pocket 7 of the uniform 6, onto which the ribbons 9 are placed, is properly spaced from the ribbons.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A military ribbon and medal alignment apparatus, said apparatus comprising:

a first lateral member and a second lateral member being spaced from each other, said first and second lateral members being aligned parallel with respect to each other, each of said first and second lateral members having a first end, a second end, an upper edge and a lower edge, said first and second ends of said first and second lateral members being aligned with each other;

a plurality of horizontal members each having a pair of opposing ends, each of said horizontal members having a top edge and a bottom edge, each of said bottom edges having a plurality of bottom notches therein, each of said bottom notches in one of said horizontal members being aligned with one of said bottom notches in each of said horizontal members when said opposing ends are aligned, each of said upper edges of said first and second lateral members being extended into one of said notches of each of said horizontal members; and each of said upper edges of said first and second lateral members having a primary slot therein positioned nearer to said first ends than said second ends of a respective one of said first and second lateral members;

said bottom notches including a first outer notch, a second outer and a prime notch positioned between corresponding ones of said first and second outer notches; and said plurality of horizontal members including a first horizontal member and a second horizontal member, said first outer notch of said second horizontal member being engaged with said primary slot of said first lateral member, the aligned one of said bottom notches of said second horizontal member receiving said upper edge of said second lateral member being engaged with said primary slot of said second lateral member;

each of said first outer notches being spaced 4 3/16 inches from a corresponding one of said prime notches, each of said first outer notches being spaced 5⅝ inches away from a corresponding one of said second outer notches, each of said first outer notches being aligned with each other and receiving said upper edge of said first lateral member and wherein the military ribbons may be aligned vertically with said first and second lateral members and horizontally aligned with said horizontal members.

2. The apparatus according to claim 1, wherein each of said first and second lateral members has a length between corresponding ones of said first and second ends equal to approximately 5 inches and a width equal to approximately ¼ inch.

3. The apparatus according to claim 2, wherein a distance between said opposing ends of each of said horizontal members is greater than 6½ inches.

4. The apparatus according to claim 1, further including:

each of said upper edges having a secondary slot therein, each of said primary slots being spaced ¼ inch from a corresponding one of said secondary slots, said secondary slots being positioned between said first ends and said primary slots of a respective one of said first and second lateral members; and said plurality of horizontal members including a third horizontal member having a first outer notch engaged with said secondary slot of said first lateral member, the aligned one of said bottom notches of said third horizontal member receiving said upper edge of said second lateral member being engaged with said secondary slot of said second lateral member; and wherein the upper edge of a pocket may be abutted against said third horizontal member to correctly space the ribbons from the pocket.

5. A military ribbon and medal alignment apparatus, said apparatus comprising:

a first lateral member and a second lateral member being spaced from each other, said first and second lateral members being aligned parallel with respect to each other, each of said first and second lateral members having a first end, a second end, an upper edge and a lower edge, said first and second ends of said first and second lateral members being aligned with each other, each of said upper edges having a primary slot therein positioned approximately ½ inch away from a respective one of said first ends, each of said upper edges having a secondary slot therein positioned about ⅛ inch away from a respective one of said first ends, each of said primary slots being spaced ¼ inch from a corresponding one of said secondary slots, each of said primary and secondary slots having a length equal to ⅛ inch, each of said first and second lateral members having a length between corresponding ones of said first and second ends equal to approximately 5 inches and a width equal to approximately ¼ inch;

a plurality of horizontal members each having a pair of opposing ends, a distance between said opposing ends being greater than 6½ inches, each of said horizontal members having a top edge and a bottom edge, each of said bottom edges having a plurality of bottom notches therein, each of said bottom notches in one of said horizontal members being aligned with one of said bottom notches in each of said horizontal members when said opposing ends are aligned, each of said top edges of said first and second lateral members being extended into one of said notches to form a rectangular frame, said bottom notches including a first outer notch, a second outer and a prime notch positioned between corresponding ones of said first and second outer notches, each of said first outer notches being spaced 4 3/16 inches from a corresponding one of said prime notches, each of said first outer notches being spaced 5 5/8 inches away from a corresponding one of said second outer notches, each of said first outer notches being aligned with each other and receiving said upper edge of said first lateral member, said top edge of said second lateral member receiving aligned ones of said bottom notches, said plurality of horizontal members including a first horizontal member and a second horizontal member, said first outer notch of said second horizontal member being engaged with said primary slot of said first lateral member, the aligned one of said bottom notches of said second horizontal member receiving said upper edge of said second lateral member being engaged with said primary slot of said second lateral member, said first horizontal member being positioned between said second horizontal member and said second ends of said first and second lateral members, said plurality of horizontal members including a third horizontal member having a first outer notch engaged with said secondary slot of said first lateral member, the other of said aligned bottom notches of said third horizontal member receiving said upper edge of said second lateral member being engaged with said secondary slot of said second lateral member; and wherein the military ribbons may be aligned vertically with said first and second lateral members and horizontally aligned with said first and second horizontal members, wherein the upper edge of a pocket may be abutted against said third horizontal member to correctly space the ribbons from the pocket.

* * * * *